US009003928B2

(12) United States Patent
Vigil

(10) Patent No.: US 9,003,928 B2
(45) Date of Patent: Apr. 14, 2015

(54) ACCESS TOOL FOR OPENING LOCKED DOORS OF VEHICLES

(71) Applicant: Aurelio A. Vigil, Miami, FL (US)

(72) Inventor: Aurelio A. Vigil, Miami, FL (US)

( * ) Notice: Subject to any disclaimer, the term of this patent is extended or adjusted under 35 U.S.C. 154(b) by 292 days.

(21) Appl. No.: 13/668,808

(22) Filed: Nov. 5, 2012

(65) Prior Publication Data

US 2014/0123814 A1 May 8, 2014

(51) Int. Cl.
*E05B 19/20* (2006.01)
*E05B 85/08* (2014.01)

(52) U.S. Cl.
CPC ..... *E05B 19/20* (2013.01); *E05B 85/085* (2013.01)

(58) Field of Classification Search
USPC ..... 81/15.9, 488, 177.2; 70/465; 269/19.1; 254/131; 294/19.1
See application file for complete search history.

(56) References Cited

U.S. PATENT DOCUMENTS

| | | | | |
|---|---|---|---|---|
| 1,798,221 | A * | 3/1931 | Porwoll | 294/100 |
| 4,655,102 | A * | 4/1987 | Parkins | 81/15.9 |
| 6,135,607 | A * | 10/2000 | Cook | 362/119 |
| 7,281,450 | B1 * | 10/2007 | Weinraub et al. | 81/15.9 |
| 8,065,938 | B1 * | 11/2011 | Kravitch | 81/177.2 |
| 2009/0000427 | A1 * | 1/2009 | Lacina | 81/15.9 |

* cited by examiner

*Primary Examiner* — Hadi Shakeri
(74) *Attorney, Agent, or Firm* — James A. Italia; Italia IP

(57) ABSTRACT

A modular access tool for operating door handles and door locks of motor vehicles from the exterior of the motor vehicle. The access tool is provided in sections which are removably attachable to one another such that the overall operative length is adjustable in discrete steps. A working head, such as a loop, a hook, or a magnet is attachable at the end of the access tool. Optionally, an illumination light may be attachable at the end of the access tool. Sections join together by threadless interference based detent devices.

6 Claims, 4 Drawing Sheets

ACCESS TOOL FOR OPENING LOCKED DOORS OF VEHICLES

FIELD OF THE INVENTION

The present invention relates to a tool for gaining access to a locked motor vehicle, for example engaging the lock button of the vehicle door.

BACKGROUND OF THE INVENTION

It is not uncommon that the owner or operator of a motor vehicle lock the doors of the motor vehicle for example with the key left in the ignition switch. This leaves the owner or operator with the problem of opening the vehicle without damaging it. Professional motorist assistance services exist and may be brought in to solve the problem, but this may cause an objectionable delay and may incur costs.

In past years owners have resorted to attempting to manually open doors if a vehicle window has been left slightly open, or by maneuvering a wire tool past the weather gasket of the door. A wire tool may be fashioned from commonly available materials such as coat hangers for example. However, in an effort to dissuade theft, vehicle manufacturers have attempted to make it more difficult to gain access to the vehicle by such measures. One of the steps many manufacturers have adopted is to eliminate or minimize the enlarged head which in past years characterized door lock buttons.

While access through the window to the door lock button and to the door handle remain among the most practical ways to engage a door lock button, current vehicle manufacturing practice now requires tools more adapted to this purpose than was formerly the case.

SUMMARY OF THE INVENTION

The present invention provides an access tool which is well suited for the task of engaging a modern door lock button to open a door of a motor vehicle. The novel tool has a long slender shaft which is sufficiently flexible as to yield to obstacles as it is maneuvered into place, yet which is sufficiently rigid as to be guided while being grasped at one end while causing a snaring loop at the opposite end to be maneuvered over the shaft of a vehicle door lock button. The novel access tool may have an internal stranded metallic cable which is capable of resisting significant manual pulling forces to accommodate opening of the vehicle door lock button.

One aspect of the invention is that it is modular in that it comprises a plurality of mutually attachable and removable components. Connections are unthreaded, for example being friction fit and locked by a detent device which does not require threading. A pin may be inserted through the long, slender body of the tool to lock two body sections together.

The novel access tool may have a variety of replaceable working heads each adapted for a particular task. For example, the tool may have a flexible loop for engaging a door handle, a rigid hook, a magnet, and a miniature flash light.

It is an object of the invention to provide a modular access tool for gaining access to locked motor vehicles.

Another object of the invention is to eliminate tedious threading of modular sections together.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
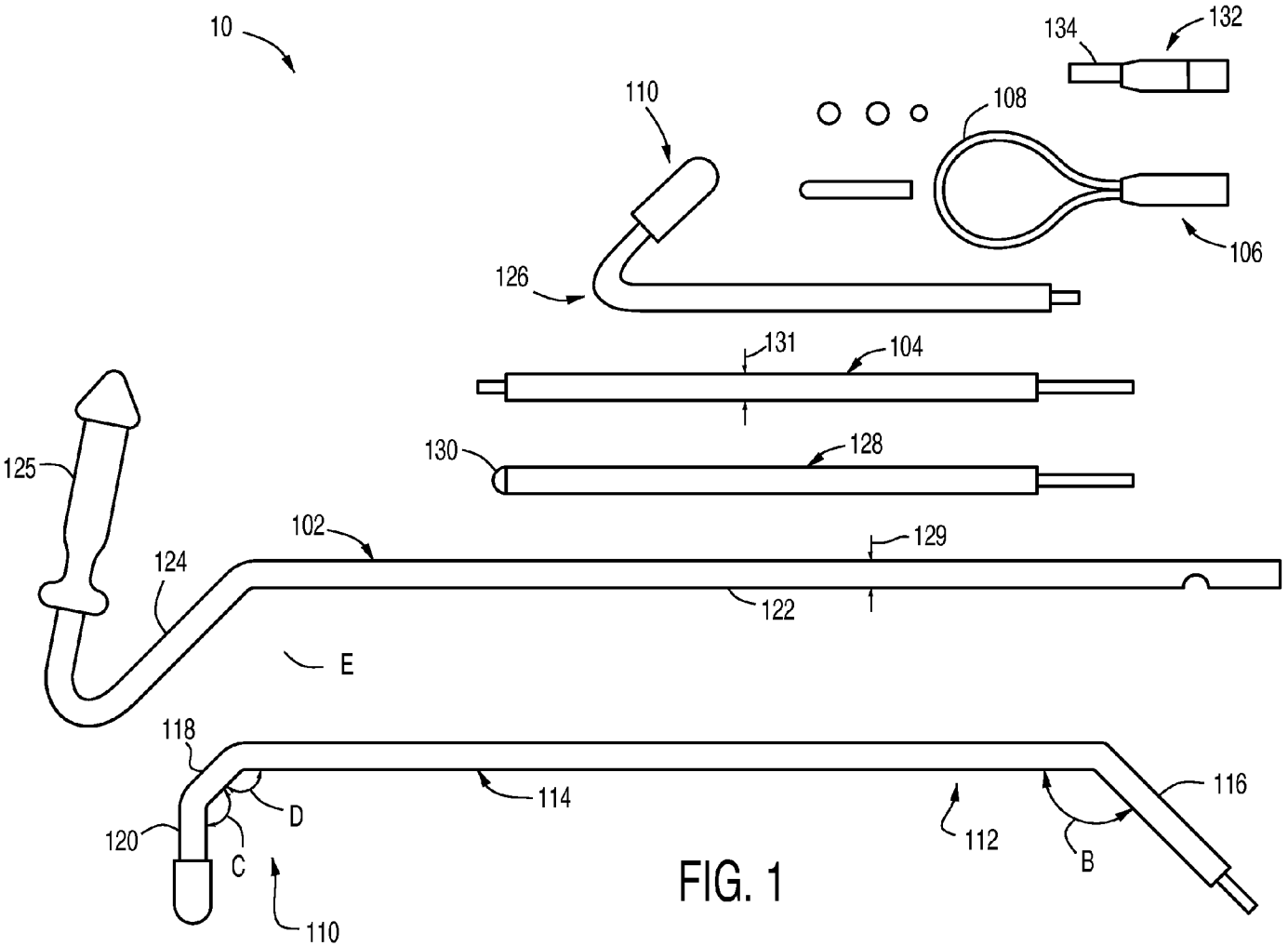
FIG. 1 is a plan view of a kit of components which may be assembled to form an access tool according to at least one aspect of the invention.
Figure 2:
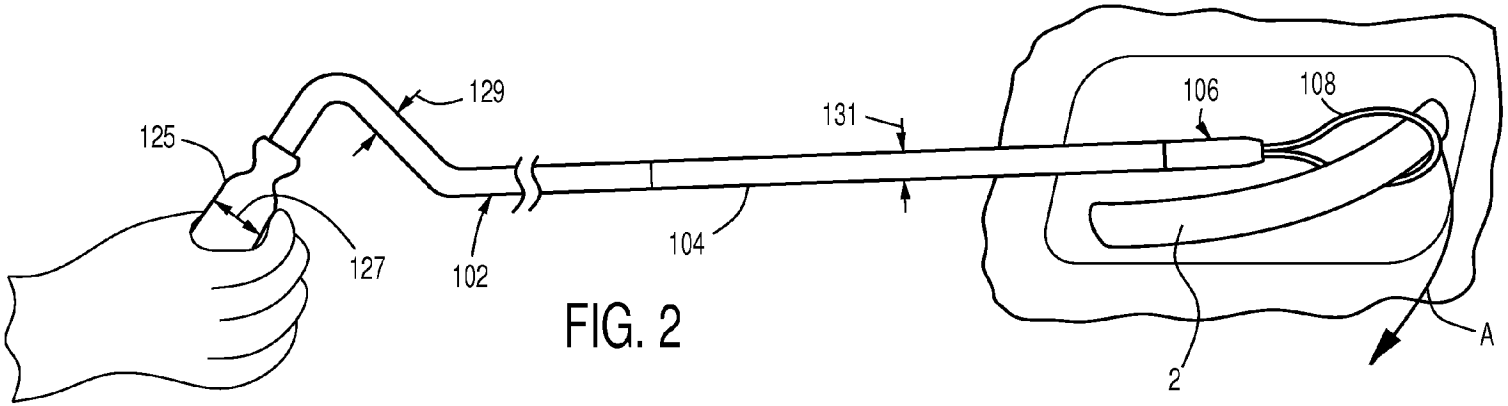
FIG. 2 is an environmental plan view of an exemplary access tool assembled from the kit of FIG. 1 in a configuration adapted to engage a door lever of a motor vehicle.

Referring first to FIGS. 1 and 2, according to at least one aspect of the invention, there is shown a kit 10 of components of the modular access tool of the present invention. The tool is modular in that firstly, it may be assembled by joining selected ones of the components depicted in FIG. 1 to form a tool having characteristics for performing one of several optional ways of engaging the door handle (see FIG. 2) or a door lock button (not shown) of a motor vehicle (a portion of which is shown in FIG. 2). Secondly, the access tool may include different components so that it takes slightly different forms according to which of the selected ones of the components have been assembled. The access tool may vary in overall length, in the type of working head assembled thereto, or in both ways. Therefore, it must be understood that any one access tool assembled from the components of the kit 10 may leave one or more components unused in any one application.

FIG. 2 shows an exemplary assembly of an access tool 100 of the present invention. The access tool 100 may comprise a main body section 102, an extension 104, and a working head 106 bearing a loop 108. In FIG. 2, the loop 108 is depicted snaring a door handle 2. Pulling by hand on the tool 100 will cause the door handle 2 to swing as indicated by the arrow A, thus opening the door. It will be appreciated that the tool 100 has been slipped into the interior of the vehicle, or the cabin, by pushing it past door and body gaskets (not shown) of the vehicle body. The components of the tool 100 are sufficiently slender as to pass through such a space.

Some vehicles may have door levers configured so as to be better engaged by a hook such as the hook 110 formed on a component 112 comprising a main arm section 114 which accounts for most of the length of the component 112, the hook 110, and an angled section 116 which may be snap fit or otherwise removably connected to the main body section 102. It will be seen in FIG. 1 that the angled section 116 may form an angle (indicated by an arrow B) of about one hundred thirty-five degrees with the main arm section 114. The hook 110 may be formed by straight sections 118, 120 arranged at an included angle (indicated by an arrow C) defined between the straight sections 118, 120 of about one hundred thirty-five degrees.

The straight section 118 may be arranged at an included angle (indicated by an arrow D) defined between the straight section 118 and the main arm section 114 of about one hundred thirty-five degrees.

The main body section 102 may also have an included angle (indicated by an arrow E) defined between a principal section 122 and a relatively short transition section 124 of about one hundred thirty-five degrees.

The main body section 102 may include a handle 125 having a diameter 127 defined along its length which is greater in magnitude than the diameter 129 of the main body section 102. It will also be appreciated that the diameter 129 of the main body section 102 is substantially similar to the diameter 131 of the extension 104. Preferably, comparable diameters of other extensions where provided, are similar to the diameter 129.

Other access tools (not shown) may be formed by incorporating additional extensions such as an extension 126 bearing the hook 110, an extension 128 bearing an illumination lamp 130, or a working head 132 incorporating a magnet 134. An illumination lamp may be formed in the dimensions and proportions of a working head such as the working head 132 if desired. Where provided, the illumination lamp may include an electrical power source such as a battery cell (not separately shown) and if desired, an externally accessible switch adapted to switch the illumination lamp on and off.

Figure 3:
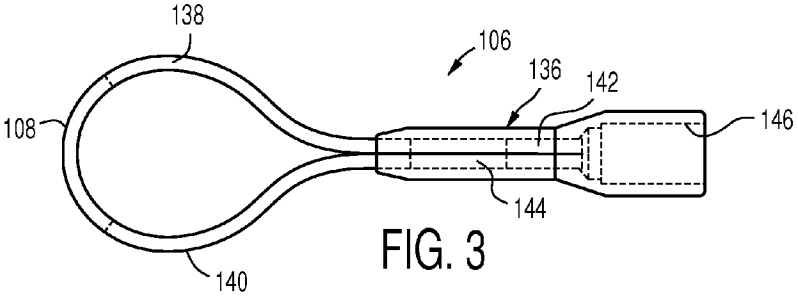
FIG. 3 is a plan view of a component bearing a loop for engaging a door handle of a motor vehicle.

FIG. 3 shows details of the working head 106. The working head 106 may comprise the loop 108 and a base 136. The loop 108 may comprise metallic strands, which may be retained within flexible sleeves 138, 140. The free ends 142, 144 of the loop 108 may be secured by crimping the base 136 thereover. The base 136 may have a socket 146 formed therein for attachment to an elongated component of the kit 10, such as the component 112, or an extension such as the extension 104.

Figure 4:
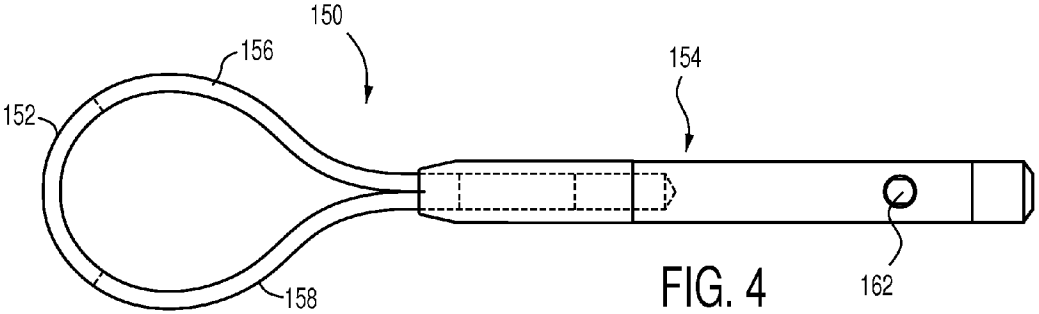
FIG. 4 is a plan view of an alternative component bearing a loop for engaging a door handle of a motor vehicle.
Figure 5:
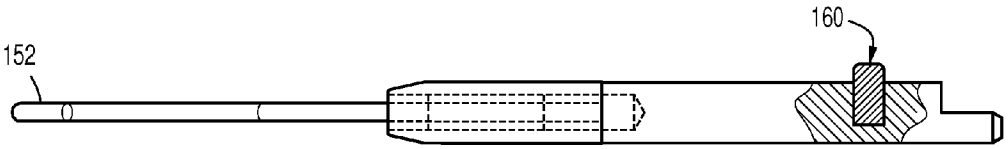
FIG. 5 is a side view of the component of FIG. 4.

FIGS. 4 and 5 show an alternative working head 150 which may comprise a loop 152 and a base 154 which entraps and retains the loop 152 by being crimped thereover for example. The loop 152 may comprise metallic strands retained and organized by sleeves 156, 158. The working head 150 may engage another component of the kit 10 other than by a socket such as the socket 146 of FIG. 3. Instead, the working head 150 may incorporate a mechanical detent device such as a pin 160. The pin 160 may engage a socket 162 by friction for example.

Other mechanical detent devices may be provided in place of the pin 160. For example, a device wherein a projecting member is spring urged to engage and project outwardly from an opening such as the socket 162, which may be pressed manually out of interference with a sleeve or other member to release engagement may be provided. This is a well known type of detent device and need not be further described herein. It is merely desirable to note that connection of elongated members such as the component 112 to an extension such as the extension 104 is preferably provided by a detent device which does not rely on screw threading, so that elongated members may be rapidly pressed together and separated when desired.

Figure 6:
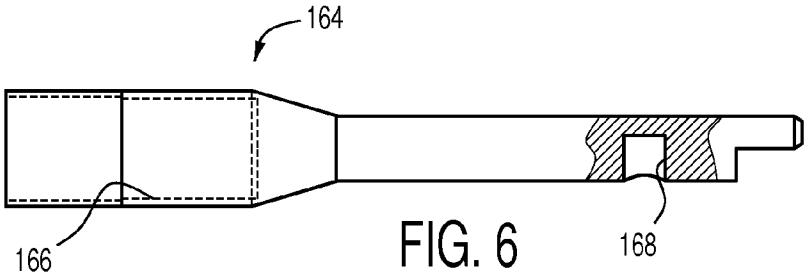
FIG. 6 is a side view, shown partially in cross section, of a working head for holding a magnet.

FIG. 6 shows a light tip extension 164. The light tip extension may have a socket 166 for connection to an elongated member and a socket 168 for receiving a pin or other mechanical detent device (neither shown).

Figure 7:
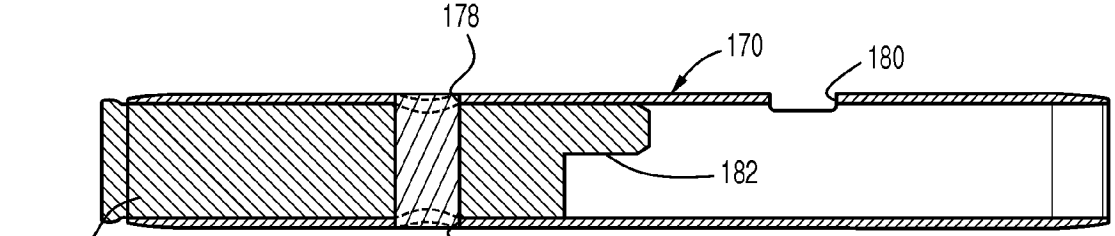
FIG. 7 is a cross sectional side view of a connector sleeve.

FIG. 7 shows a connection arrangement which may be employed to connect elongated members such as the component 112, extensions such as the extension 104, and working heads such as the working head 106 if desired. In this arrangement, a sleeve 170 forms a female member into which may be inserted a male member such as an end terminal 172. The end terminal may have a throughbore 174 which may be aligned with holes 176, 178 formed in the sleeve 170 to receive a mechanical detent device such as a pin (not shown). The sleeve 170 may have an aditional hole 180 which may receive a complementing end terminal (not shown, but which may be similar to the end terminal 172), so that two end terminals may be retained within the sleeve 170 by pins. It will be appreciated that the end terminal 172 has a tongue 182 which occupies half of the open interior space of the sleeve 170. This accommodates a corresponding tongue of the complementing end terminal in close cooperation therewith. That is, a complementing tongue may occupy that portion of the sleeve 170 which is left unoccupied by the tongue 182, where the complementing tongues overlap one another for a portion of the length of the sleeve 170.

Figure 8:
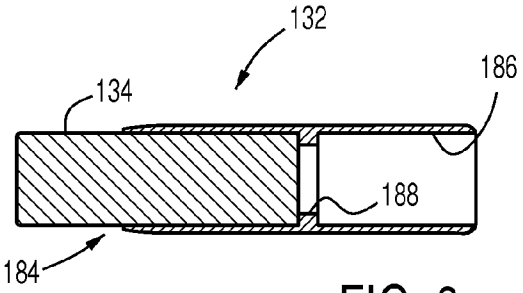
FIG. 8 is a side cross sectional view of an alternative working head for holding a magnet.

The working head 132 is shown in detail in FIG. 8. The magnet 134 is seen received within a socket 184 which faces in one direction, with an oppositely opening socket 186 facing an opposite direction. The sockets 184, 186 may be separated by an internal flange 188 which limits penetration of the magnet 134 into the socket 184 and by an elongated member such as the component 112 or an extension such as the extension 104 into the other socket 186.

Figure 9:
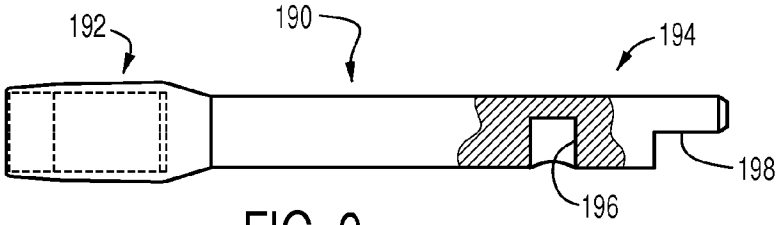
FIG. 9 is a side view, shown partially in cross section, of still another holder for a magnet.

As seen in FIG. 9, a magnet (not shown) may be retained within a working head 190. The working head 190 may comprise a socket 192 which may be crimped over the magnet, and an engagement end 194 comprising a socket 196 and a tongue 198 which is structurally and functionally similar to the tongue 182 of FIG. 7.

Figure 10:
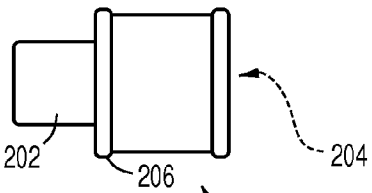
FIG. 10 is a top view of a connector.
Figure 12:
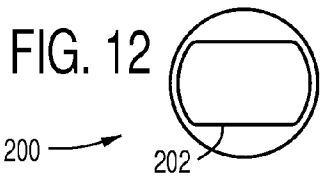
FIG. 12 is an end view of the connector of FIG. 10.
Figure 11:
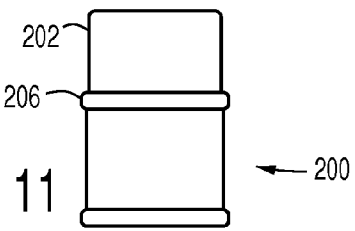
FIG. 11 is a side view of the connector of FIG. 10.

FIGS. 10, 11, and 12 show an adaptor 200 which may be employed to join elongated members such as the component 112, extensions such as the extension 104, and working heads such as the working head 106 if desired. The adaptor 200 may comprise a tongue 202, a socket 204, and an outwardly projecting low wall 206 which limits penetration of the adaptor 200 into an elongated member or working head by interference fit.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A modular access tool for remotely operating interior locks and handles of a motor vehicle to enable a person to gain access to the interior of a locked motor vehicle from outside the motor vehicle, comprising a main body comprising a handle at its proximal section and a slender, elongated distal section;

a main arm comprising a working head at its proximal section and a slender, elongated distal section, a threadless connector disposed to releasably join the distal section of the main arm to the proximal section of the main body without rotating the proximal section relative to the distal section, wherein the working head is disposed to engage at least one of the door lock button and the door handle of the motor vehicle;

an extension having a diameter along it length which is substantially similar to the diamer of the main arm; and a connection arrangement including a sleeve wherein the main arm comprises a tongue and the extension comprises a tongue which overlap one another along the length of the sleeve and occupy the interior of the sleeve.

2. A modular access tool for remotely operating interior locks and handles of a motor vehicle to enable a person to gain access to the interior of a locked motor vehicle from outside the motor vehicle, comprising:

a main body comprising a handle at its proximal section and a slender elongated distal section;

a main arm comprising a working head connector at its proximal section and a slender, elongated distal section, a threadless connector disposed to releasably join the distal section of the main arm to the to the proximal section of the main body without rotating the proximal section relative to the distal section;

an extension having a diameter along its length which is substantially similar to the diameter of the main arm; and, a connection arrangement including a sleeve wherein the main arm comprises a tongue and the extension comprises a tongue which overlap one another along the length of the sleeve and occupy the interior of the sleeve.

3. The modular access tool of 2, further comprising a working head releasably connected to the working head connector of the main arm.

4. The modular access tool of claim 2, wherein the working head comprises a loop.

5. The modular access tool of claim 2, wherein the working head comprises a hook.

6. The modular access tool of claim 2, wherein the working head comprises a magnet.

* * * * *